US005293934A

United States Patent [19]

Burge et al.

[11] Patent Number: 5,293,934

[45] Date of Patent: Mar. 15, 1994

[54] GROUND WATER SAMPLING UNIT HAVING A FLUID-OPERATED SEAL

[76] Inventors: Russell W. Burge, 21140 Covina Hills Rd., Covina, Calif. 91724; Scott R. Burge, 8869 S. Myrtle, Tempe, Ariz. 85284

[21] Appl. No.: 937,715

[22] Filed: Sep. 1, 1992

[51] Int. Cl.[5] ..... E21B 23/04; E21B 49/08

[52] U.S. Cl. ..... 166/202; 73/151; 73/863; 166/179; 166/264; 210/170

[58] Field of Search ..... 73/151, 155, 863; 166/202, 264, 387, 179, 187; 210/179, 143; 277/170; 175/58, 59; 417/56, 545, 551, DIG. 2

[56] References Cited

U.S. PATENT DOCUMENTS

| | | | |
|---|---|---|---|
| 2,218,155 | 10/1940 | Rusler et al. | 73/155 |
| 2,564,198 | 8/1951 | Elkins | 166/264 |
| 3,113,455 | 12/1963 | Sloan et al. | 73/155 |
| 4,717,473 | 1/1988 | Burge et al. | 210/170 |
| 5,033,551 | 7/1991 | Grantom | 166/202 |
| 5,147,561 | 9/1992 | Burge et al. | 210/170 |

*Primary Examiner*—Joseph W. Drodge
*Attorney, Agent, or Firm*—Boniard I. Brown

[57] ABSTRACT

A lowerable-raisable ground water sampling device has an annular elastomeric seal for preventing the exchange of atmospheric gases with the ground water within a well casing. In its preferred form, the seal is a frusto-conical elastomeric disk mounted on the lower end of a water-extraction tube depending from the lower end of a water sampling unit. A fluid-actuator cylinder is floatable positioned on the tube for moving an annular wall structure downwardly against the disk upper surface, thus to decrease the cone angle of the frusto-conical surface to cause the outer edge of the disk to move out of sealing engagement with the well casing surface. When the fluid cylinder is depressurized, the frusto-conical disk automatically expands to seal against the well casing surface.

12 Claims, 2 Drawing Sheets

GROUND WATER SAMPLING UNIT HAVING A FLUID-OPERATED SEAL

BACKGROUND OF THE INVENTION

1. Field of the Invention

The present invention relates to ground water sampling devices of the general type shown in U.S. Pat. No. 4,717,473 to Burge, et al. The present invention relates more particularly to a seal structure usable on the sampling unit to prevent exchange of atmospheric gases with the sub-surface ground water.

2. Prior Art

U.S. Pat. No. 4,717,473 discloses a ground water sampler device lowerable into a well casing for collecting samples of sub-surface ground water in the well casing. The sampler device has an annular elastomeric sealing sleeve inflatable to sealably engage the casing wall, to prevent the sampled ground water from being contaminated or altered by contact with above-ground atmospheric gases. The elastomeric sealing sleeve is pressurized by compressed air through a small diameter hose extending from the round surface to the sampling unit. The sealing sleeve is required to be pressurized in order to seal against the well casing. Should the air pressure be lost for any reason, the sealing sleeve will be depressurized and will move out of sealing engagement with the well casing. In some cases the sampling unit remains in the well casing for several months, and the sealing sleeve on the sampling unit is therefore required to remain in a pressurized state for the entire period of time that the sampling unit is in the well casing. The long period of seal pressurization increases the probability of seal failure by pressure loss. Also, the continuous pressurization forces tend to unduly stress the seal material because such forces are exerted on the seal material for prolonged time periods.

BRIEF SUMMARY OF THE INVENTION

The present invention relates to a ground water sampling device having a seal structure to sealably engage an associated well casing without requiring that the seal structure be inflated or pneumatically pressurized. The seal of the invention is so designed that it can be wedged against the well casing without applying inflation air pressure. The seal mechanism is released from engagement with the well casing by air-operating deforming means, which is required to be energized only when it is desired to raise or lower the ground water sampling device in the well casing. During most of the time that the sampling unit is in the well casing the seal deforming means is in an inactive, depressurized state. Therefore, the seal is not subjected to air pressurization forces while it is in sealing engagement with the well casing.

A principal object of the invention is to provide a seal for a ground water sampling device, wherein pneumatic pressure moves the seal out of engagement with the well casing, rather than into engagement with the well casing. Such a seal will have an improved life expectancy, and provides greater assurance against momentary or prolonged loss of sealing action while the water sampling device is in service in the well casing.

In a preferred form of the invention, the sealing element comprises a generally circular disk on the underside of the sampling device, and formed of an elastomeric material. The disk is so mounted that is has a frusto-conical configuration, with its outer annular edge adapted to seal against the well casing. The weight of the sampling unit causes the ground water to exert an upward force on the frusto-conical disk, whereby the disk outer edge is wedged into sealing engagement with the well casing. An air cylinder-operated annular deforming means is movable vertically downwardly against the upper surface of the elastomeric disk when it is desired to move the disk out of sealing engagement with the well casing. The annular deforming means acts to decrease the disk cone angle, whereby the disk outer edge moves away from the well casing surface.

DESCRIPTION OF A PREFERRED EMBODIMENT OF THE INVENTION

Figure 1:
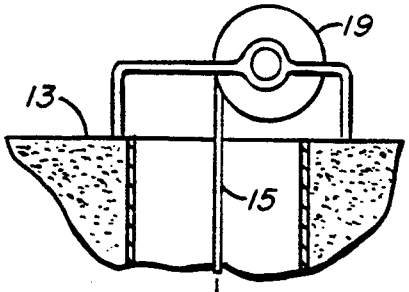
FIG. 1 is a schematic sectional view illustrating a ground water sampling device utilizing sealing means of the present invention.

Referring to the drawings and particularly to FIG. 1, there is shown a ground water sampling device 10 having a cylindrical housing 14 raisable and lowerable with a cylindrical well casing 11 which extends downwardly from ground surface 13. Cable means 15 extends from he roof area 17 of housing 14 upwardly and around rotary winch means 19, whereby the sampling device 10 can be raised or lowered to obtain and retrieve ground water samples from the water table. Compressed air and electrical power are supplied to components within sampling unit 10, either by a hose and electrical wiring contained within cable means 15, or by a separate hose and electrical cable extending between the sampling unit and the ground surface.

Sampling unit 10 may be constructed as shown in the aforementioned U.S. Pat. No. 4,717,473. For illustrative purposes, the sampling unit may include a water pumping system comprising a double acting air cylinder 21 having a piston rod 23 connected to a piston 25 in a water-pumping cylinder 27. An electrically-controlled valve 29 is located below cylinder 27 to permit ground water to flow from subjacent space 28 upwardly through a vertical passage 31 into cylinder 27.

Compressed air is supplied to air cylinder 21 by an air line 33 that extends through an electrical valve 35 to branch lines connected to cylinder spaces above and below air piston 37. By electrically programming valve 35, piston 37 is movable in reciprocable fashion to drive the water piston 25 up and down in cylinder 27, thus to provide a water pumping action.

A check valve 39 permits water to flow from cylinder 27 through a line 41 and a selector valve 43 that is connected to water sample collection compartments 45. It is thus possible to collect water samples from zone 28 for subsequent analysis after the sampling unit has been raised to the earth surface. Alternately, with suitable instrumentation it is possible to analyze the ground water samples while the sampling unit is in the well casing. Electrical and pneumatic power are supplied to the sampling unit 10 via flexible cables and hoses, as previously mentioned.

Figure 2:
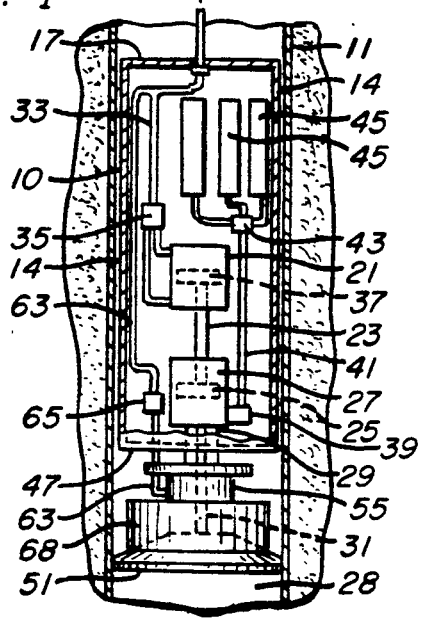
FIG. 2 is an enlarged view, partially in section, showing structural details of the sealing means of FIG. 1, with the sealing means in engagement with an associated well casing.
Figure 2:
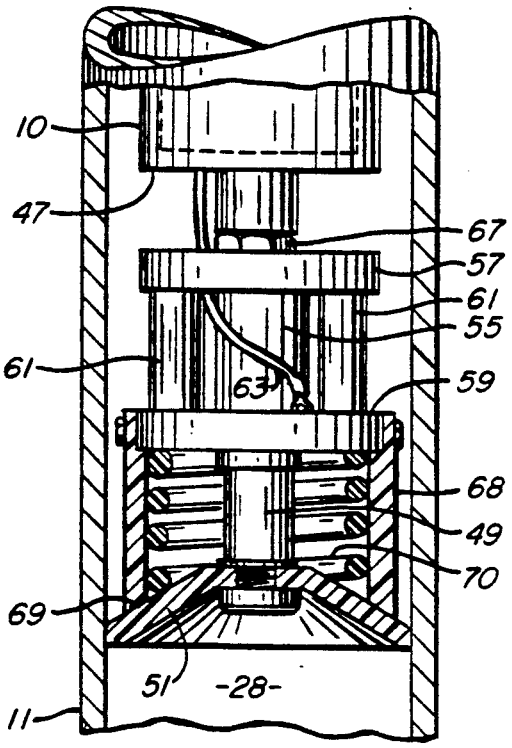
Figure 3:
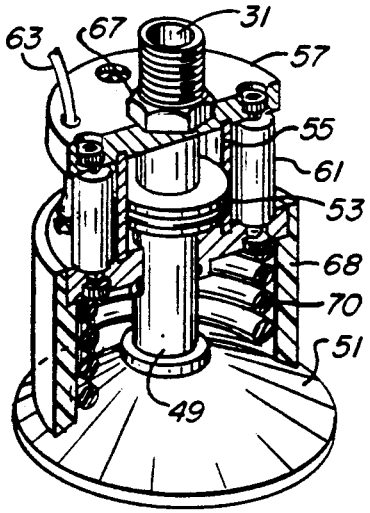
FIG. 3 is a perspective view of the sealing means of FIG. 2.
Figure 4:
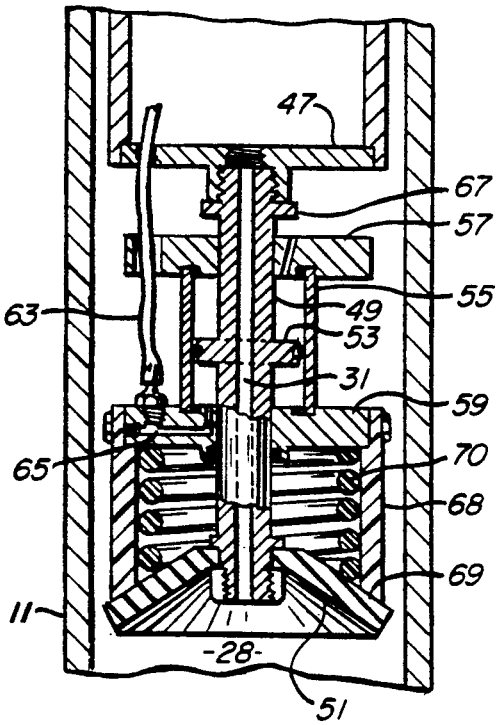
FIG. 4 is a sectional view, similar to the view of FIG. 2, showing the sealing means disengaged from the well casing.

The present invention is more particularly concerned with a sealing assembly disposed below the bottom wall 47 of housing 14. As shown in FIGS. 2 through 4, the sealing assembly comprises a hollow cylindrical water-extraction tube 49 extending downwardly from wall 47 to define the aforementioned passage 31. The upper end of tube 49 has a threaded connection with wall 47.

Figure 5:
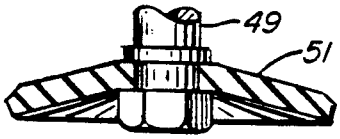
FIG. 5 is a sectional view of a sealing element of the FIG. 2 sealing assembly, showing the sealing element prior to installation on the sampling device.

At its lower end tube 49 mounts an elastomeric circular sealing disk element 51. As shown in FIG. 5, the disk element may be somewhat dished in its as-formed state. When the sealing element is in its installed position of FIGS. 2 and 4, the element has a frusto-conical configuration.

Water-extraction tube 49 carries a circular piston 53 within an encircling fluid cylinder 55. The cylinder has a cylindrical side wall, an upper end wall 57, and a lower end wall 59. The end walls 57 and 59 may be rigidly connected together by a series of tie rods 61 or other connector devices so that the defined fluid cylinder is floatably mounted on tube 49.

A pressurization fluid, e.g., compressed air, can be introduced to the cylinder space below piston 53 via a flexible hose 63 and port structure 65 in cylinder end wall 59. Tie rods 61 are not shown in FIG. 4 in order to better illustrate hose 63, which extends upwardly through bottom wall 47 of the water sampling unit. As shown generally in FIG. 1, hose 63 extends vertically upwardly within the sampling unit housing to join with the aforementioned air line 33. Thus, compressed air may be delivered from the ground surface 13 to both line 33 and hose or line 63. An electrically-operated valve 65 (FIG. 1) is provided to control air flow through hose 63. The valve may include a vent passage to vent the portion of hose 63 below the valve when the valve is closed.

An annular cylindrical wall structure 68 extends downwardly from end wall 59 of fluid cylinder 55, and has its lower annular edge 69 engaged with the upper surface of sealing element 51. FIG. 2 shows the condition of the sealing assembly when cylinder 55 is depressurized, with valve 65 closed. Water pressure in zone 28 acts on the undersurface of disk element 51 to urge the outer edge of the disk element into sealing engagement with well casing 11. Cylinder 55 is moved upwardly on water-extraction tube 49 so that its upper end wall 57 abuts an annular shoulder formed by the wrench flat area 67 of the tube.

A relatively heavy coil spring, preferably formed of neoprene spring rubber, extends between the upper surface of sealing disc element 51 and cylinder end wall 59. The spring assists in holding or maintaining the seal in its outwardly extended, flattened configuration and force to urge it radially outward. This eliminates leakage problems in the event of deterioration or fatigue of seal 57 in long service periods of wells, and insures that seal 51 can still maintain sealing.

FIG. 4 shows the condition of the sealing assembly when the cylinder space below piston 53 is pressurized, the cylinder 55 being moved downwardly on tube 49 so that annular wall structure 68 deforms sealing element 51 out of sealing engagement with casing 11. This disengagement of the sealing element from casing 11 permits the water sampling unit to be moved freely up or down within casing 11, as by actuation of winch mechanism 19.

It will be understood from FIGS. 2 and 4 that the included cone angle of the frusto-conical sealing disk 51 is somewhat greater in the FIG. 2 condition, as compared to the FIG. 4 condition. The downward motion of annular wall structure 68 deforms the cone surface to produce the necessary change in cone angle, whereby the outer edge of the disk is moved out of engagement with casing 11. If desired, a stop may be provided on the tube 49 to limit downward motion of fluid cylinder 55 and the associated wall structure 68.

A principal advantage of the sealing construction of FIGS. 2 through 4 is that the actuating cylinder is pressurized only when it is desired to release the sealing element from engagement with the well casing. When the water sampling unit is stationed in the well casing for sampling purposes, cylinder 55 is in a depressurized condition. Thus, sealing element 51 is subjected only to the ground water pressure acting on the disk element undersurface. A relatively long seal element service life is thus provided.

Figure 7:
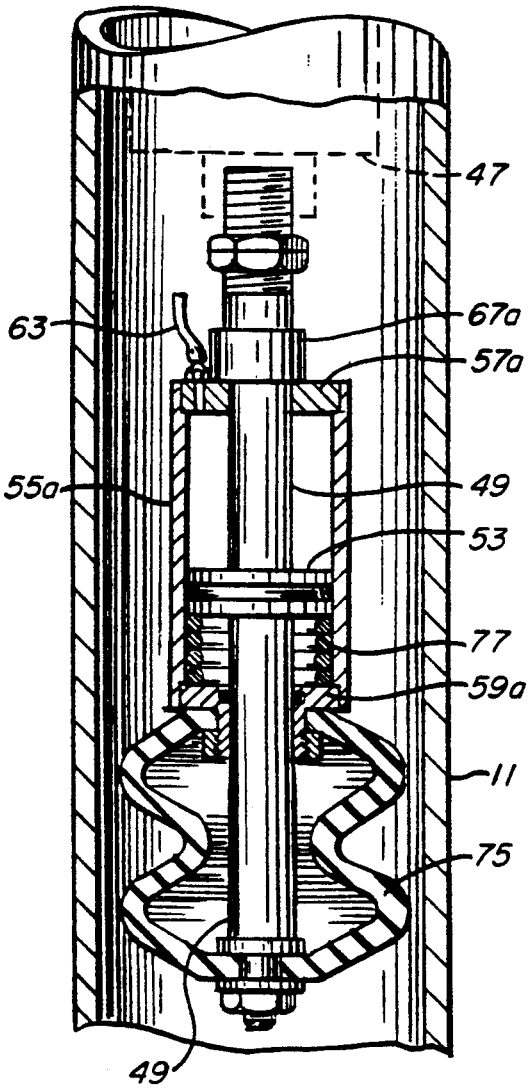
FIGS. 6 and 7 are sectional views of another sealing assembly according to the invention, FIG. 6 showing the sealing element engaged against the well casing, and FIG. 7 showing the sealing element disengaged from the well casing.
Figure 6:
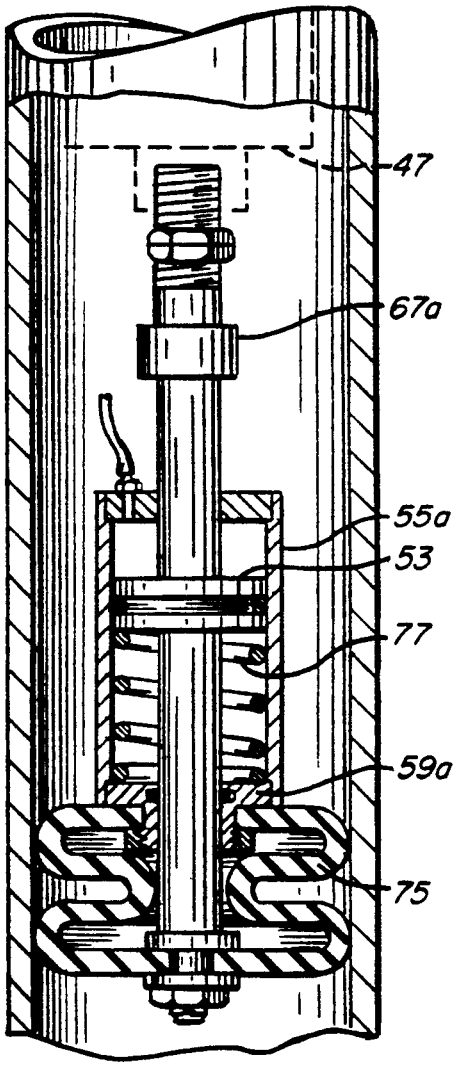

A second embodiment of the invention is shown in FIGS. 6 and 7, and has a sealing element comprising an elastomeric bellows 75 having one end wall thereof secured to the lower end of water-extraction tube 49. The upper end of the bellows is secured to the lower end wall 59*a* of a fluid cylinder 55*a*. Compressed air or other pressurization fluid can be introduced into the space above piston 53 via the flexible air line or hose 63 and an associated port in end wall 57*a* of the fluid cylinder. When the cylinder space above piston 53 is depressurized, a compression coil spring 70 expands to move cylinder 55*a* upwardly to its FIG. 7 position. Such upward motion is limited by engagement of the cylinder end wall 57*a* with shoulder means 67*a*.

FIG. 6 depicts the condition of the sealing assembly in the sealing mode, i.e., with the peripheral edge area of the elastomeric bellows sealably engaged with the well casing. FIG. 7 depicts the condition of the sealing assembly in the released mode or position, wherein the sealing element is out of engagement with the well casing. An advantage of the FIGS. 6, 7 construction is that the actuating cylinder 55*a* has to be pressurized only during the time when it is desired to disengage the sealing element from the well casing; at other times the cylinder is in a depressurized condition.

Thus there has been shown and described a novel ground water sampling unit having a fluid-operated seal, which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims;

1. A ground water sampling device adapted for engagement with a well casing, comprising:

a water collection housing having a bottom wall, a hollow water-extraction tube extending downwardly from said housing bottom wall, a deformable sealing element carried by said tube and extending laterally outwardly from the tube, said sealing element having a peripheral edge sealably engageable with the well casing to prevent exchange of atmospheric gases with the ground water, remotely-controllable deforming means for selectively deforming the sealing element out of engagement with the well casing, whereby the water collection housing is then freely movable up or down within the well casing, said deforming means comprising a piston carried by the tube, and a fluid cylinder encircling the piston, whereby pressurization of the cylinder interior on one side of the piston moves the cylinder vertically along the tube, said cylinder having edge means facing the sealing element, and means defining a chamber below the piston adapted to be pressurized to urge the cylinder downwardly along the tube to urge said edge out of engagement with the well casing.

2. A sampling device according to claim 1, wherein the cylinder is depressurized when the sealing element is sealably engaged with the well casing.

3. A sampling device according to claim 1, wherein:

the sealing element comprises a circular disk disposed below the fluid cylinder, and said disk has a frusto-conical configuration.

4. A sampling device according to claim 3, and further including:

resilient means engaging the sealing element to assist in maintaining the sealing element deformed and in sealing engagement with the well casing.

5. A sampling device according to claim 3, wherein:

the fluid cylinder has an end wall, and further including:

spring means between the sealing element and the fluid cylinder end wall to assist in maintaining the sealing element deformed and in sealing engagement with the well casing.

6. A sampling device according to claim 1, and further including:

resilient means engaging the sealing element to assist in maintaining the sealing element deformed and in sealing engagement with the well casing.

7. A ground water sampling device adapted for engagement with a well casing, comprising:

a water collection housing having a bottom wall, a hollow water-extraction tube extending downwardly from said housing bottom wall, a deformable sealing element carried by said tube and extending laterally outwardly from the tube, said sealing element having a peripheral edge sealably engageable with the well casing to prevent exchange of atmospheric gases with the ground water, remotely-controllable deforming means for selectively deforming the sealing element out of engagement with the well casing, whereby the water collection housing is then freely movable up or down within the well casing, said deforming means comprising a piston carried by the tube, and a fluid cylinder encircling the piston, whereby pressurization of the cylinder interior on one side of the piston moves the cylinder vertically along the tube, said sealing element comprising a circular disk disposed below the fluid cylinder, said deforming means comprising an annular wall structure carried by the cylinder, said annular wall structure having a lower edge engageable with said disk inwardly of the disk peripheral edge, and the cylinder having a space defined below the piston adapted to be pressurized to urge the cylinder downwardly along the tube to deform the sealing element out of engagement with the well casing.

8. A ground water sampling device adapted for engagement with a well casing, comprising:

a water collection housing having a bottom wall, a hollow water-extraction tube extending downwardly from said housing bottom wall, a deformable sealing element carried by said tube and extending laterally outwardly from the tube, said sealing element having a peripheral edge sealably engageable with the well casing to prevent exchange of atmospheric gases with the ground water, remotely-controllable deforming means for selectively deforming the sealing element out of engagement with the well casing, whereby the water collection housing is then freely movable up or down within the well casing, said deforming means comprising a piston carried by the tube, and a fluid cylinder encircling the piston, whereby pressurization of the cylinder interior on one side of the piston moves the cylinder vertically along the tube, said fluid cylinder having upper and lower end walls slidable on said tube, wherein the cylinder is floatably mounted on the tube.

9. A sampling device according to claim 8, wherein:

said tube has shoulder means located above the upper end wall of the cylinder, and said cylinder is so dimensioned that when the sealing element is engaged with the well casing the cylinder upper end wall abuts the shoulder means.

10. A ground water sampling device adapted for engagement with a well casing, comprising:

a water collection housing having a bottom wall, a hollow water-extraction tube extending downwardly from said housing bottom wall, a deformable sealing element carried by said tube and extending laterally outwardly from the tube, said sealing element having a peripheral edge sealably engageable with the well casing to prevent exchange of atmospheric gases with the ground water, remotely-controllable deforming means for selectively deforming the sealing element out of engagement with the well casing, whereby the water collection housing is then freely movable up or down within the well casing, said deforming means comprising a piston carried by the tube, and a fluid cylinder encircling the piston, whereby pressurization of the cylinder interior on one side of the piston moves the cylinder vertically along the tube, said fluid cylinder has upper and lower end walls slidable on said tube, wherein the cylinder is floatable mounted on the tube, the lower end wall of the cylinder having fluid port means therein for flow of fluid into or out of the cylinder.

11. A ground water sampling device adapted for engagement with a well casing, comprising:

a water collection housing having a bottom wall, a hollow water-extraction tube extending downwardly from said housing bottom wall, a deformable sealing element carried by said tube and extending laterally outwardly from the tube, said sealing element having a peripheral edge sealably engageable with the well casing to prevent exchange of atmospheric gases with the ground water, the sealing element comprising a circular disk disposed below the fluid cylinder, said disk having a frusto-conical configuration, remotely-controllable deforming means for selectively deforming the sealing element out of engagement with the well casing, whereby the water collection housing is then freely movable up or down within the well casing, said deforming means comprising a piston carried by the tube, and a fluid cylinder encircling the piston, whereby pressurization of the cylinder interior on one side of the piston moves the cylinder vertically along the tube, said deforming means further comprising an annular wall structure carried by the fluid cylinder, said annular wall structure having a lower edge engageable with said disk inwardly of the disk peripheral edge, and said annular wall structure being movable downwardly by the fluid cylinder to decrease the cone angle of the frusto-conical disk, whereby the disk peripheral edge is moved out of engagement with the well casing.

12. A sampling device according to claim 11, wherein:

the fluid cylinder has an end wall, and further including:

spring means between the sealing element and the fluid cylinder end wall to assist in maintaining the sealing element deformed and in sealing engagement with the well casing.

* * * * *